United States Patent [19]

Schirm

[11] Patent Number: 4,471,588

[45] Date of Patent: Sep. 18, 1984

[54] TIE ROD

[76] Inventor: Klaus W. Schirm, Erlenkamp 19, D-2000 Hamburg 76, Fed. Rep. of Germany

[21] Appl. No.: 369,019

[22] PCT Filed: Aug. 13, 1981

[86] PCT No.: PCT/DE81/00122

§ 371 Date: Apr. 9, 1982

§ 102(e) Date: Apr. 9, 1982

[87] PCT Pub. No.: WO82/00672

PCT Pub. Date: Mar. 4, 1982

[30] Foreign Application Priority Data

Aug. 13, 1980 [DE] Fed. Rep. of Germany ..... 3030634

[51] Int. Cl.[3] ..... E04H 12/20

[52] U.S. Cl. ..... 52/154; 52/157; 52/165

[58] Field of Search ..... 52/157, 154, 166, 153, 52/165, 152, 155

[56] References Cited

U.S. PATENT DOCUMENTS

| | | | |
|---|---|---|---|
| 1,373,560 | 4/1921 | Holland | 52/157 X |
| 1,606,146 | 11/1926 | Cole et al. . | |
| 2,395,033 | 2/1946 | Black | 52/157 |
| 3,011,597 | 12/1961 | Galloway et al. | 52/157 X |
| 3,011,598 | 12/1961 | Galloway . | |

FOREIGN PATENT DOCUMENTS

| | | | |
|---|---|---|---|
| 4820 | 10/1979 | European Pat. Off. . | |
| 1501061 | 9/1966 | France . | |
| 2112838 | 6/1972 | France . | |
| 2422793 | 11/1979 | France . | |
| 39314 | 12/1960 | Luxembourg . | |
| 438159 | 11/1967 | Switzerland . | |
| 717221 | 2/1980 | U.S.S.R. | 52/157 |

*Primary Examiner*—Carl D. Friedman

*Attorney, Agent, or Firm*—Andrus, Sceales, Starke & Sawall

[57] ABSTRACT

A tie rod used to support loads or light weight structures located on pallets. The tie rod comprises an anchoring rod which has a screwing disk located at the bottom end, an attachment device located at the top end, and an axially displaceable spreading foot. The anchoring rod has a pointed end below the screwing disk.

6 Claims, 16 Drawing Figures

Figure 2A:
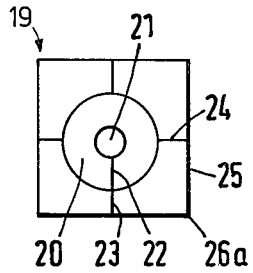

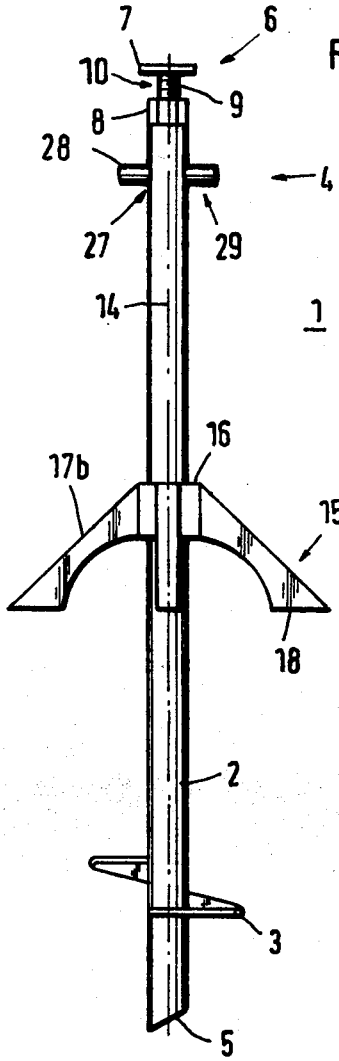
Fig.1a
Fig.1c
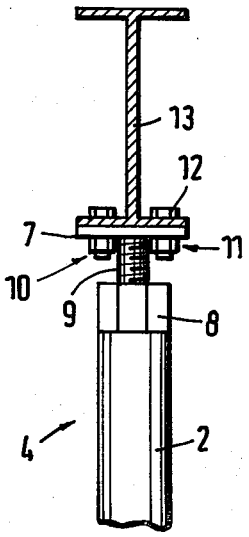
Fig.1b
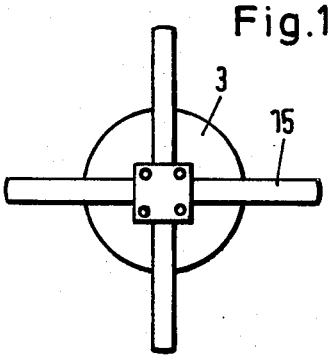

TIE ROD

The invention relates to a tie rod with a screwing disk having a hollow anchoring rod pointed at the bottom end and provided with an attachment device at the top end.

Tie rods are used as a replacement for strip or spot foundations for carrying loads or light-weight structures located e.g. on pallets. Known tie rods are mainly constructed for tensile anchoring means. They cannot bear working loads or can only bear them to a limited extent. In addition, the known tie rods have the disadvantage that forces acting vertically to the longitudinal axis thereof, such as e.g. horizontally acting wind pressure loads cannot be taken up, because then the tie rods tilt around the screwing disks in the soil. It is therefore necessary to additionally secure by means of inclined brackets or the like objects supported on tie rods and exposed to wind pressure loads. This considerably increases the assembly effort and expenditure.

The problem of the invention is to provide a tie rod which can be fitted in conventional manner and which is suitable for taking vertical and horizontal loads.

According to the invention, this problem is solved in that the support plate of the attachment device is constructed as to be displaceable coaxially to the anchoring rod, on which is mounted a spreading foot displaceable between the screwing disk and a stop at the top end of the anchoring rod. The tie rod constructed in this way is ideally suited for use in loose soils, such as fine gravel or sand.

Further features of the invention are described in the subclaims and are illustrated hereinafter by means of the tie rod shown in the drawings. In the drawings show:

FIG. 1*a* a side view of the tie rod according to the invention.

FIG. 1*b* a plan view of the tie rod according to FIG. 1*a*.

FIG. 1*c* the top end of the tie rod according to FIG. 1*a* in a larger scale detailed side view.

FIGS. 2*a* to 4*c* further embodiments of the spreading foot for the tie rod according to FIG. 1 in side views and plan views.

Figure 5A:
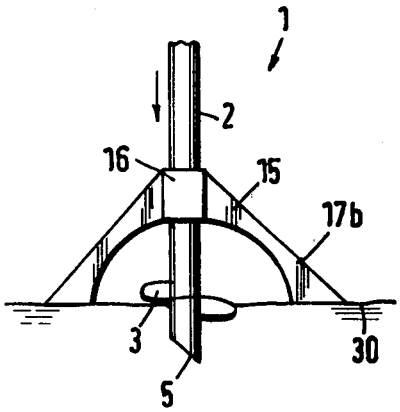
Figure 5B:
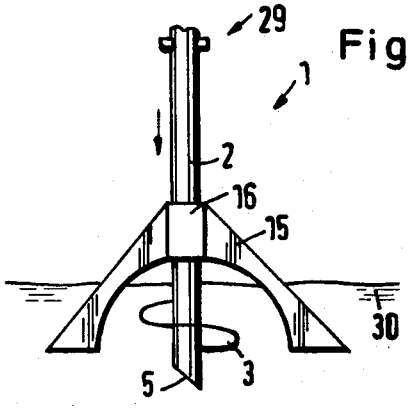

FIGS. 5*a* and 5*b* the tie rod according to FIG. 1 in side views and different installation positions.

Figure 6:
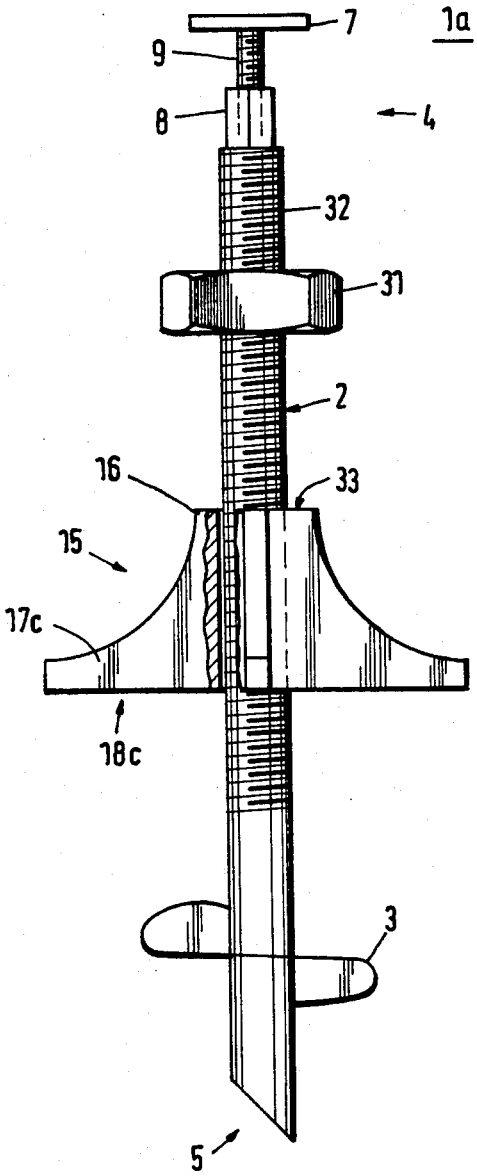

FIG. 6 another construction of the tie rod according to the invention in side view and partly in section.

Tie rod 1 shown in FIG. 1*a* comprises an anchoring rod 2 with a chamfered bottom end 5. Above the latter, a helically constructed screwing disk 3 is connected to the anchoring rod 2. An attachment device 6 is constructed on the top end 4 of the anchoring rod 2. A stop 29 is located below the attachment device 6. Between stop 29 and screwing disk 3 there is a spreading foot 15, which is displaceably mounted on the anchoring rod between stop 29 and screwing disk 3. Attachment device 6 comprises a support plate 7, which is displaceable coaxially with respect to the central axis 14 of anchoring rod 2. For this purpose, a threaded sleeve 8 constructed as a threaded nut is provided on the top end 4 and into it is screwed a threaded bolt 9. Support plate 7 is fixed to the free end 10 of threaded bolt 9 (FIG. 1*c*). Support plate 7 has openings 11, through which are inserted screws 12, by means of which the support member 13 is fixed to support plate 7. A pallet or the like can be fixed to support plate 7 by means of screws 12 in place of support member 13.

Below the threaded sleeve 8, two facing openings 27 are formed on the top end 4 of anchoring rod 2 and through which can be inserted a bolt 28 and stop 29. To secure bolt 28 against loss, it is possible to use a separate, not shown shim. This shim can be constructed as an elastic packing ring, fixed in openings 27. When the bolt 28 is guided by the picking rings, the latter elastically engage on bolt 28 and secure it against loss. The shims can, for example also be replaced by a safety chain, which is fixed to the free ends of bolt 28.

Figure 2B:
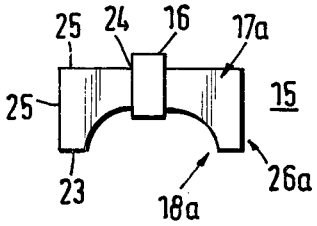
Figure 2C:
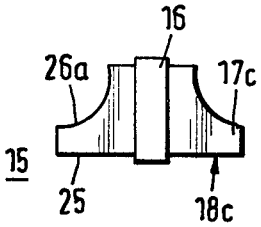
Figure 3A:
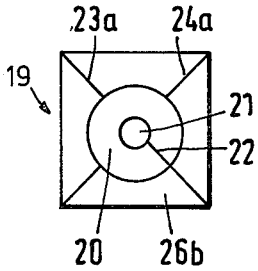
Figure 3B:
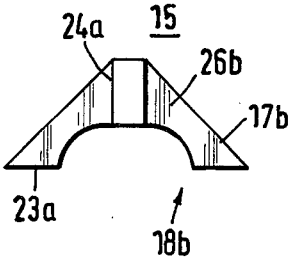
Figure 4A:
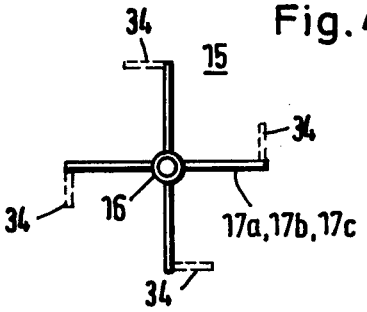
Figure 4B:
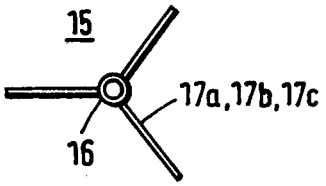
Figure 4C:
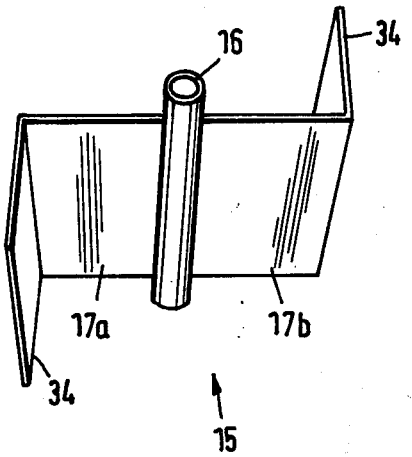

The spreading foot 15 comprises a sleeve 16 displaceably mounted on anchoring rod 2 and on which supports 17*a*, 17*b*, 17*c* are positioned radially with respect to rod 2 (FIGS. 2*b*, 2*c*, 3*b*). The number of supports 17*a*, 17*b*, 17*c* is unlimited. However, advantageously at least three supports 17*a*, 17*b*, 17*c* are used, which are displaced at the same angle with respect to one another (FIG. 4*b*). However, it is also possible to fix four or more supports 17*a*, 17*b*, 17*c* to sleeve 16 (FIG. 4*a*). Supports 17*a*, 17*b*, 17*c* are constructed in such a way that they project over the screwing disk 3 (FIGS. 1*a* and 1*b*).

Preferably, the supports 17*a*, 17*b*, 17*c* comprise plate segments 26*a*, 26*b*, which are removed from a sheet metal or similar blank 19. As shown in FIGS. 2*a* and 3*a*, the supports 17*a*, 17*b*, 17*c* are constructed as quarterportions of the sheet metal or similar blank 19. The circular disk 20 cut centrally out of blank 19 can be shaped as a screwing disk 3. For this purpose, it is merely necessary to form an opening 21 corresponding to the external diameter of anchoring rod 20 in the centre of disk 20, whilst making a radial parting cut 22 from the outer edge of disk 20 and up to opening 21.

FIGS. 2*b*, 2*c* and 3*b* show possible constructions of the spreading foot 15. In the case of foot 15 according to FIG. 2*b*, the cut edges 24 of plate segment 26*a* are connected to sleeve 16, whilst cut edges 23 form part of the support surface 18*a*. In the case of foot 15 according to FIG. 2*c*, in each case one outer edge 25 of plate segment 26*a* is directly constructed as part of the support face 18*c*, whilst the other outer edges 25 are located on sleeve 16. In the case of foot 15 according to FIG. 3*b*, the plate segments 26*b* are connected to sleeve 16. These plate segments 26*b* have been formed by diagonal cuts in blank 19. The cut edges 24*a* of plate segments 26*b* are connected to sleeve 16, whilst the cut edges 23*a* from part of support face 18*b*.

Pressure plates 34, aligned parallel to the anchoring rod, can also be provided on ends of supports 17*a*, 17*b*, 17*c* remote from sleeve 16 (FIG. 4*a*). Preferably, the pressure plates 34 are arranged at an angle to supports 17*a*, 17*b*, 17*c* and can in particular form a right angle with respect to the latter, as shown by the dotted lines in FIG. 4*a*. The spreading foot can also be given a Z-shaped configuration through the use of pressure plates 34. The Z-shaped foot 15 of FIG. 4*c* comprises two plate-like supports 17*a*, 17*b* fixed to the sleeve 16 in one plane. At the free ends of supports 17*a*, 17*b*, the pressure plates 34 are arranged at right angles thereto.

Figure 5C:
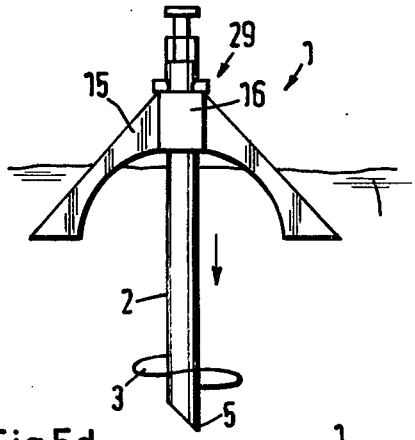
Figure 5D:
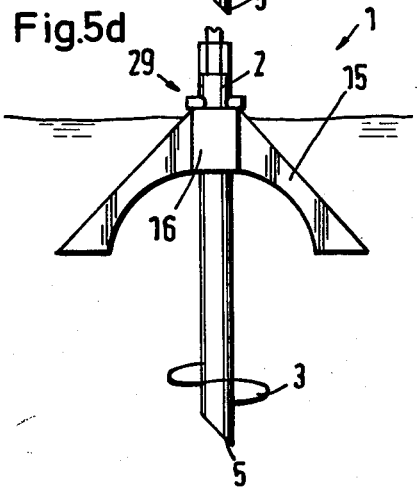

The installation and function of tie rod 1 will be explained by means of FIGS. 5*a* to 5*d*. Before inserting tie rod 1 in soil 30, support plate 7 is detached from the top end 4 of tie rod 1 and a spreading foot 15 is placed on anchoring rod 2. Threaded bolt 9 with support plate 7 is then again screwed into the threaded sleeve 8. Anchoring rod 2 of tie rod 1 is then placed on the soil of the intended installation site, top end 5 being pressed slightly into soil 30 by manual means. Spreading foot 5, whose support 17*b* projects over screwing disk 3 is then also pressed into soil 30 (FIG. 5*a*). Anchoring rod 2 is then turned by means of a spanner or the like fitted to the threaded sleeve 8, so that rod 2 is drawn through screwing rod 3 into the soil (FIG. 5*b*). When stop 29 rests on sleeve 16 of foot 15 and anchoring rod 2 has been introduced further into the soil, foot 15 is also drawn into the soil 30 (FIG. 5*c*). When foot 15 is sufficiently firmly anchored in soil 30, the screwing of anchoring rod 2 into the soil is at an end (FIG. 5*d*).

If, in the manner described hereinbefore, a tie rod 1 introduced into soil 30 is subject to horizontal forces by wind loads and the like, a tilting around the screwing disk 3 is prevented by spreading foot 15 braced against soil 30 being supported on the latter by means of its support faces 18*b*. Thus, the tie rod is able to take up both vertical and horizontal loads. An alignment of the height level of support plates 7 is possible through merely rotating threaded bolt 9. This makes it possible to compensate different insertion depths of different tie rods 1 or a gradient of the ground.

It is also possible to construct a tie rod 1*a* in the manner shown in FIG. 6. In the case of tie rod 1*a*, an external thread 32 is formed on anchoring rod 2, sleeve 16 of spreading foot 15 being displaceably mounted on thread 32. Any of the aforementioned embodiments of spreading foot 15 can be used. Above foot 15, there is a nut 31, which is screwed onto external thread 32. Nut 31 can be turned on the top face 33 of sleeve 16, independently of the operation of anchoring rod 2. As a result, the tie rod 1*a* requires less force on turning into soil 30, because firstly anchoring rod 2 is introduced and then foot 15 is pressed into soil 30 by means of nut 31. In addition, the separate operation of the anchoring rod 2 and pressing foot 5 by means of nut 31 also facilitates the alignment of tie rod 1*a*.

I claim:

1. A tie rod with a screwing disk for breaking earth and having a hollow anchoring rod with a pointed bottom end and a top end having an attachment device with a support plate, characterized in that said support plate is constructed so as to be displaceable coaxially vertically along said anchoring rod and on it is mounted a spreading foot displaceable between said screwing disk and a stop at said top end, said foot having support means extending radially beyond said screwing disk and having outer laterally offset support faces for engaging earth unbroken by said screwing disk and translating horizontal force at said top end of said rod into laterally offset vertically downward force from said support faces, and characterized in that an external thread is formed on said anchoring rod and on which is displaceably mounted a nut, and wherein said foot has a sleeve with a top face, and wherein said nut can be engaged on said top face of said sleeve of said foot.

2. The tie rod according to claim 1 wherein said top end of said anchoring rod has a threaded sleeve in which is mounted a threaded bolt having a free end on which is positioned said support plate and characterized in that the external diameter of said threaded sleeve of said anchoring rod is the same or smaller than the core diameter of said external thread formed on said anchoring rod.

3. The tie rod according to claim 2, characterized in that said threaded sleeve of said anchoring rod has an outer casing with flat portions for attaching a tool.

4. The tie rod according to claim 3, characterized in that said threaded sleeve of said anchoring rod is constructed as a threaded nut connected to said anchoring rod.

5. A tie rod with a screwing disk for breaking earth and having a hollow anchoring rod with a pointed bottom end and a top end having an attachment device with a support plate, characterized in that said support plate is constructed so as to be displaceable coaxially vertically along said anchoring rod and on it is mounted a spreading foot displaceable between said screwing disk and a stop at said top end, said foot having support means extending radially beyond said screwing disk and having outer laterally offset support faces for engaging earth unbroken by said screwing disk and translating horizontal force at said top end of said rod into laterally offset vertically downward force from said support faces, and characterized in that said support faces extend horizontally, for engagement with earth substantially parallel to the latter's top surface, to provide maximum support of vertically downward force from said support faces.

6. A tie rod with a screwing disk for breaking earth and having a hollow anchoring rod with a pointed bottom end and a top end having an attachment device with a support plate, characterized in that said support plate is constructed so as to be displaceable coaxially vertically along said anchoring rod and on it is mounted a spreading foot displaceable between said screwing disk and a stop at said top end, said foot having support means extending radially beyond said screwing disk and having outer laterally offset support faces for engaging earth unbroken by said screwing disk and translating horizontal force at said top end of said rod into laterally offset vertically downward force from said support faces, and characterized in that said support faces lie in a horizontal plane no higher than the remainder of said foot radially inboard of said support faces.

* * * * *